United States Patent [19]

Bolis

[11] 4,072,209

[45] Feb. 7, 1978

[54] MECHANIC'S STAND

[76] Inventor: Gary W. Bolis, Box 81, Creamery, Pa. 19430

[21] Appl. No.: 730,093

[22] Filed: Oct. 6, 1976

[51] Int. Cl.[2] ..... E04G 1/24

[52] U.S. Cl. ..... 182/116; 182/152

[58] Field of Search ..... 182/16, 17, 116, 155, 182/13, 152; 248/454, 291; 297/445

[56] References Cited

U.S. PATENT DOCUMENTS

| | | | |
|---|---|---|---|
| 722,864 | 3/1903 | Lorenz et al. | 182/175 |
| 1,470,052 | 10/1923 | Blair | 248/454 |
| 2,480,406 | 8/1949 | Forney | 182/3 |
| 2,575,573 | 11/1951 | Wiedman | 182/155 |
| 2,701,168 | 2/1955 | Schemers | 182/16 |
| 2,969,123 | 1/1961 | Jamerson | 182/17 |
| 2,970,668 | 2/1961 | Snyder | 182/116 |

FOREIGN PATENT DOCUMENTS

| | | | |
|---|---|---|---|
| 249,308 | 9/1966 | Austria | 297/445 |

*Primary Examiner*—Reinaldo P. Machado
*Attorney, Agent, or Firm*—J. Rodman Steele, Jr.

[57] ABSTRACT

An apparatus which supports the body of one working over the engine compartment of an automobile, without otherwise impairing freedom of movement and without relying on any part of the automobile for support, comprising a tubular base and extended frame, pivotally connected to one another, with means for locking the extended frame into an obliquely elevated position with respect to the base. The apparatus stably flexes under load, providing comfortable support in general and relieving back strain in particular. The extended frame and base fold together for convenient storage. In an alternative embodiment, the height of the extended frame is adjustable.

9 Claims, 3 Drawing Figures

FIG. 1
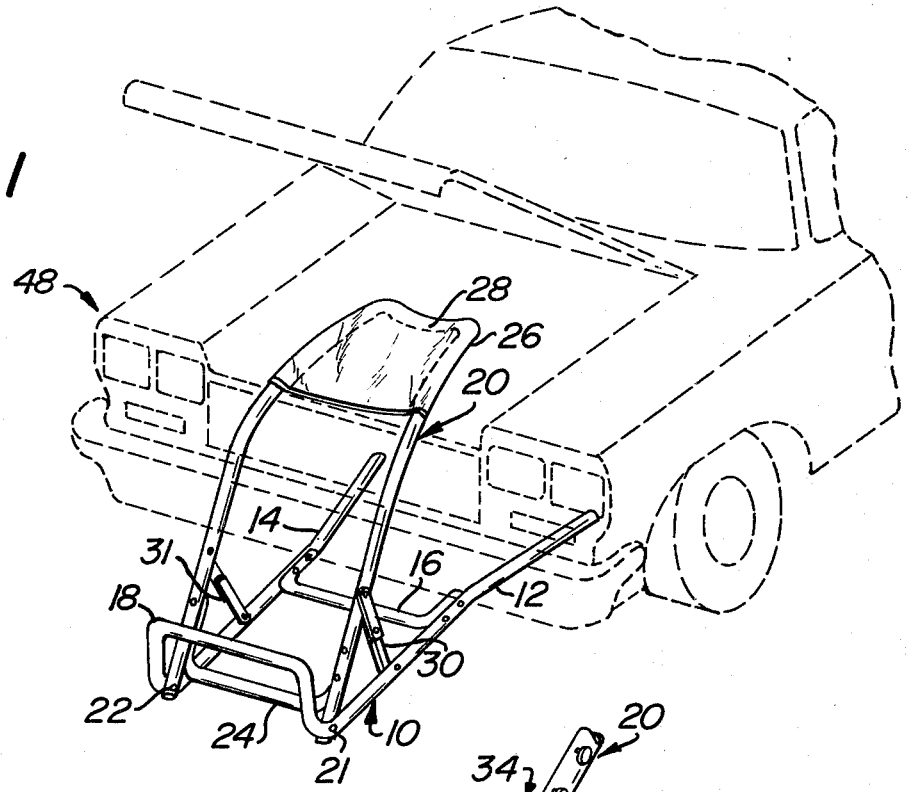
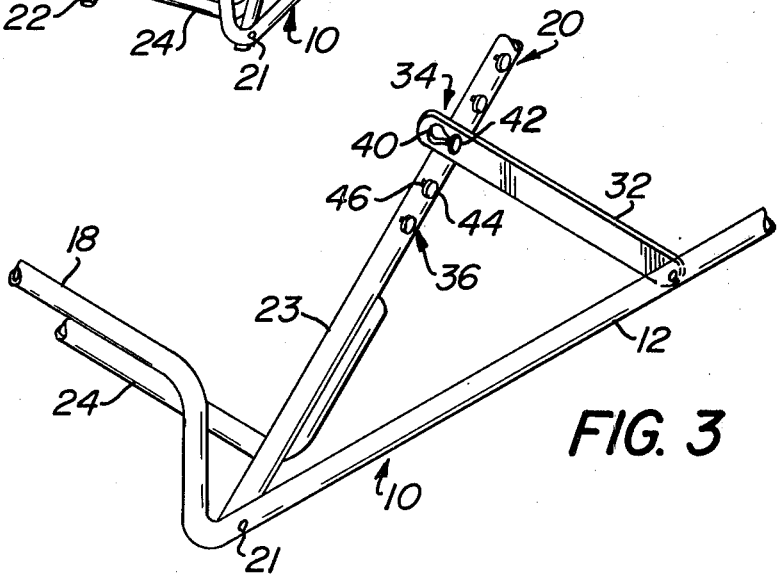
FIG. 3
FIG. 2
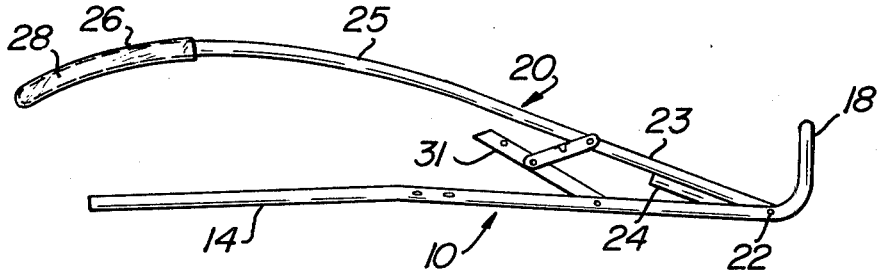

MECHANIC'S STAND

BACKGROUND OF THE INVENTION

In the field of automotive repair, mechanics can work on an engine by crawling underneath the automobile, by placing the automobile on a hydraulic or pneumatic lift, or by leaning or crawling over the front fenders or radiator to reach the engine from the top.

When working down from over the engine of an automobile, there are significant problems. One problem is to be able to reach areas of the engine which are distant from the front or side fenders of the car. Generally, the larger the car, the greater the problem. A second problem is the severe back strain which results from maintaining the extended, leaning position for any period of time. This back strain can be only partially alleviated by leaning on the engine itself, which offers for support sharp protuberances, rough, greasy surfaces and, often as not, metal which is hot enough to blister skin on contact. A third problem, related to the two foregoing problems, is the marring of the outside surfaces of the automobile, particularly the tops of fenders, while the mechanic leans on and over them.

Cushioned mats, which have soft undersides and durable top covers, are available for offering some protection to the outside surfaces of the automobile. The mats, however, are subject to sliding around, due to the normal body motion of the mechanic leaning on them, and they become quite grimy with time. Accessibility to engine areas is not increased, nor is comfort increased.

The subject invention, however, provides full body support for a mechanic working over the engine compartment of an automobile. The apparatus provides easy access to the innermost areas of the engine, completely obviating the need for seeking any additional support upon any surface of the engine and without any marring contact with the outside surfaces of the automobile. In view of the fact that the subject invention obviates the need for a mechanic to prop himself up with at least one hand or elbow, a mechanic utilizing the subject invention now has full freedom of motion for both arms, making his job that much easier. In the preferred embodiments, the subject invention is further designed such that the whole apparatus stably flexes under load, thereby resulting in additional comfort.

Some prior art references bear some structural resemblance to elements of the subject invention. One is U.S. Pat. No. 2,480,406 (Forney) which discloses a similarly shaped, but non-foldable tubular frame with a supporting material stretched therebetween. The user sits on the frame as though it were a chair, with his legs pushed through a hole in the supporting material and his feet still touching the ground. There is no means provided in the base elements to permit stable flexing or to withstand side-to-side rocking, as in the subject invention. A second is U.S. Pat. No. 1,162,000 (Turner) which discloses a ladder supported by a base member, with an adjustable diagonal base disposed therebetween.

It is clear that neither of these devices is in any way suitable for comfortably and stably supporting the body of a mechanic working over the engine compartment of an automobile.

BRIEF SUMMARY OF THE INVENTION

It is an object of this invention to provide a device for comfortably supporting the body of one working over the engine compartment of an automobile, while permitting full freedom of motion for both arms.

It is another object of this invention to provide a device which will relieve the back strain which would otherwise result from leaning over the fenders of an automobile to work over the engine compartment thereof.

It is a further object of this invention to provide a supporting device for the body of one working over the engine compartment of an automobile which prevents one from contacting, and by its very design will not itself contact, any greasy, sharp, rough or hot parts of the engine, to prevent injuries or damage therefrom.

It is a still further object of this invention to provide a supporting device for the body of one working over the engine compartment of an automobile which prevents one from contacting, and by its very design will not itself contact, the outside surfaces of the automobile, to prevent marring thereof.

It is yet another object of this invention to provide an apparatus which flexes under loading, for supporting the body of one working over the engine compartment of an automobile.

It is yet another object of this invention to provide an apparatus which is stable with respect to side-to-side rocking motions, for supporting the body of one working over the engine compartment of an automobile.

It is yet another object of this invention to provide an apparatus which is adjustable to any desired height, for supporting the body of one working over the engine compartment of an automobile.

It is yet another object of this invention to provide apparatus for supporting the body of one working over the engine compartment of an automobile which may be folded nearly flat for convenient storage when not in use.

Briefly described, the subject invention has a base and an extended frame, each constructed from metallic tubular elements, which may be pivotally joined.

The base is comprised of two substantially horizontal legs, which may be arched and which are connected to one another by a transverse base. The extended frame may also be arched and has a transverse brace at its lower end and supporting means attached to its uppermost section. A raised step, serving the additional function of a base, may be connected to the base or the lower end of the extended frame.

Means may also be provided for locking the extended frame into an obliquely elevated position with respect to the base. In one embodiment, the locking means comprise a pair of self-locking folding hinges disposed between the extended frame and the base. In another embodiment, wherein the extended frame is adjustable to any desired height, the locking means comprise a pair of rigid straps pivotally connected to the legs of the base. A slotted keyway in the end of each strap opposite from the base is detachably and selectively engagable with one of a plurality of headed connectors on respective sides of the extended frame.

The base and extended frame may be pivotally connected so as to fold against one another, for convenient storage as an essentially flat object.

BRIEF DESCRIPTION OF THE DRAWINGS

FIG. 1 is a perspective view of the apparatus as used;

FIG. 2 is a side view of the apparatus while partially folded; and,

FIG. 3 is a perspective view of alternate locking means used in the embodiment which is adjustable to any desired height.

DETAILED DESCRIPTION OF THE PREFERRED EMBODIMENTS

With reference to FIG. 1, the subject invention has two major components, a base 10 and an extended frame 20. Each is constructed from metallic tubular elements, such as aluminum or steel pipe.

The base 10 has two legs 12 and 14. Each leg is arched so that it contacts the ground only at its end points. At approximately the high point of the arch, near the mid-point of each leg, the legs 12 and 14 are connected to a base brace 16. At one end, the legs 12 and 14 are also connected to a raised step 18, which also serves as a brace. The raised step 18 serves two additional functions. The first is to lift the user further into the engine compartment and to prevent slipping off the device. The second is permitting full utilization of the device's flexing characteristics to allow the greatest comfort, which flexing is not as pronounced when the user leans against the device with his feet on the ground. The legs 12 and 14, from a point on the side of the base brace 16 opposite to the step 18, are splayed outward from one another. The arching of the legs 12 and 14 permits the base 10 of the subject invention to flex under load. The splayed legs provide additional stability against side-to-side rocking motion.

With reference to FIG. 1 and FIG. 2, the extended frame 20 is so arched as to define an essentially straight lower section 23, a somewhat curved middle section 25 and an upper section 26, which upper section is essentially level with respect to the ground when the apparatus is fully unfolded. The extended frame 20 also flexes under load. The two sides of the lower section 23 are connected with a frame brace 24. A means for supporting a load 28 is attached to the extended frame 20 in the area of its upper section 26. The supporting means 28 may be a fabric, such as canvas, or molded plastic.

The extended frame 20 and the base 10 are pivotally attached at hinged connections 21 and 22. The extended frame 20 and base 10 are further connected by self-locking folding hinges 30 and 31.

As shown by the partially collapsed view of FIG. 2, the device may be folded nearly flat for easy storage when not in use.

In another embodiment, the extended frame 20 is adjustable to any desired height. A suitable means for adjustably locking the extended frame 20 into its obliquely elevated position with respect to the base 10 is shown in FIG. 3. A rigid strap 32 is rotatably connected to the leg 12. At the other end of the rigid strap 32 is a slotted keyway 34. Mounted on the extended frame 20 are a plurality of headed connectors 36. The slotted keyway 34 has a circular section 40 which is just large enough to slip easily over the top 44 of a headed connector 36. The slotted portion 42 of the slotted keyway 34 is just sufficiently large for the neck 46 of the headed connector 36 to slip therein. A rotatably connected rigid strap 32 and set of headed connectors 36 would replace each self-locking folding hinge 30 and 31 as shown in FIG. 1. When the rigid straps 32 are disengaged from all headed connectors 36, the device of this embodiment will also fold nearly flat for easy storage.

It is to be clearly understood that means of locking the extended frame 20 into an obliquely elevated position with respect to the base 10 other than those described herein are available and the subject invention is not to be construed as being limited to those kinds of locking means disclosed herein.

FIG. 1 demonstrates use of the apparatus with an automobile 48, depicted in phantom. The base 10 is supported on the same surface upon which the automobile 48 rests. The legs 12 and 14 are slipped underneath the automobile 48. The extended and inclined frame 20 arches over the front fender or radiator of the automobile, and the upper section 26 of the extended, inclined frame 20 is disposed over the engine compartment of the automobile 48. The mechanic steps onto the raised step 18 and leans forward on the extended, sloped frame 20, his inclined torso resting on support means 28. In this inclined position, the mechanic is supported comfortably over the engine compartment of the automobile, he is not contacting either the outside surfaces of the automobile or any inside surfaces of the engine, both of his arms are free to move in all directions, including under the apparatus, and both the extended frame 20 and the legs 12 and 14 of the base 10 are free to flex slightly under the mechanic's weight.

The apparatus can also be used to work on the engine of the automobile from either side. The distance separating the legs 12 and 14 of the base 10 is sufficiently wide so that each leg can slip around a front tire. The base brace 16 is sufficiently recessed from the ends of the legs 12 and 14 so as not to impede the motion of the base as it is pushed underneath the automobile.

It can be appreciated that a mechanic could remain comfortably supported upon the apparatus for a considerable length of time, without incurring any back strain, can avoid being injured or unnecessarily soiled by coming in contact with the engine itself in areas not being worked on and can completely avoid contacting and marring the outside surfaces of the automobile 48.

In view of the above, the present invention may be embodied in other specific forms, without departing from the spirit or essential attributes thereof, and, accordingly, reference should be made to the appended claims, rather than to the foregoing specification as indicating the scope of the subject invention.

I claim:

1. A mechanic's stand, for supporting the body of one working over the engine compartment of motor vehicle or the like, comprising:

a base having substantially horizontal, but flexibly arched legs;

an extended, flexibly arched frame connected to said base and inclined to extend above the engine compartment when said stand is directionally positioned in close proximity to the motor vehicle; a step mounted on said stand adjacent to said connection between said base and said extended frame, said step extending upwardly from said base and spaced away from said extended frame; and, means mounted on said extended frame for supporting the torso of said worker in an inclined working position above the engine compartment.

2. The mechanic's stand of claim 1 wherein said base is substantially "U" shaped, thereby enabling said stand to be moved into close proximity with a wheel of said motor vehicle, said legs extending on each side of said wheel.

3. The mechanic's stand of claim 1 wherein said extended frame has an upper section defined by the arch of said extended frame and said supporting means is attached to said upper section.

4. The mechanic's stand of claim 1, further comprising a pivotal connection between said base and said extended frame and means disposed between said base and said extended frame for locking said extended frame into elevated position, permitting said base and said extended frame to each flex under load.

5. The mechanic's stand of claim 4 wherein said locking means comprises at least one self-locking folding hinge.

6. The mechanic's stand of claim 4 wherein said locking means comprises a rigid strap rotatably connected to said base, said strap having a slotted keyway oppositely disposed to said rotatable connection, and a plurality of headed connectors firmly mounted on said extended frame, selectively and detachably engagable by said slotted keyway.

7. The mechanic's stand of claim 1 wherein said base, said extended frame and said step are comprised of metallic tubes.

8. The mechanic's stand of claim 1 wherein said supporting means is fabric.

9. The mechanic's stand of claim 1 wherein said supporting means is molded plastic.

* * * * *